US009418580B2

(12) United States Patent
Kim et al.

(10) Patent No.: US 9,418,580 B2
(45) Date of Patent: Aug. 16, 2016

(54) DISPLAY APPARATUS HAVING A SHORT GATE LINE AND METHOD OF DRIVING THE SAME

(75) Inventors: Su Jeong Kim, Seoul (KR); Heeseop Kim, Suwon-si (KR); Kichul Shin, Suwon-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 652 days.

(21) Appl. No.: 13/613,368

(22) Filed: Sep. 13, 2012

(65) Prior Publication Data

US 2013/0271504 A1 Oct. 17, 2013

(30) Foreign Application Priority Data

Apr. 12, 2012 (KR) ..... 10-2012-0038079

(51) Int. Cl.

| | |
|---|---|
| ***G09G 3/36*** | (2006.01) |
| ***G09G 3/00*** | (2006.01) |
| ***G09G 3/34*** | (2006.01) |

(52) U.S. Cl.

CPC ..... *G09G 3/003* (2013.01); *G09G 3/3426* (2013.01); *G09G 3/3614* (2013.01); *G09G 2300/0426* (2013.01); *G09G 2310/0237* (2013.01); *G09G 2310/0262* (2013.01); *G09G 2310/0278* (2013.01)

(58) Field of Classification Search

CPC ..... G09G 3/003; G09G 3/3614; G09G 2300/0426

See application file for complete search history.

(56) References Cited

U.S. PATENT DOCUMENTS

| | | | | |
|---|---|---|---|---|
| 5,581,273 | A * | 12/1996 | Yoneda et al. | 345/90 |
| 6,900,870 | B2 | 5/2005 | Song | |
| 7,095,478 | B2 | 8/2006 | Zhang et al. | |
| 7,199,850 | B2 | 4/2007 | Jun | |
| 7,593,069 | B2 | 9/2009 | Oh et al. | |
| 7,626,656 | B2 | 12/2009 | Jang et al. | |
| 7,952,548 | B2 | 5/2011 | Kim et al. | |
| 2006/0231838 | A1* | 10/2006 | Kim | 257/59 |
| 2007/0290977 | A1 | 12/2007 | Cheng et al. | |
| 2009/0167734 | A1 | 7/2009 | Chian-Hung et al. | |
| 2010/0207954 | A1 | 8/2010 | Kim | |
| 2010/0289884 | A1 | 11/2010 | Kang | |
| 2011/0128269 | A1 | 6/2011 | Lee et al. | |
| 2012/0113102 | A1* | 5/2012 | Sato et al. | 345/419 |

FOREIGN PATENT DOCUMENTS

| | | | |
|---|---|---|---|
| JP | 08006526 | A | 1/1996 |
| JP | 2009181097 | A | 8/2009 |
| KR | 1020100051755 | A | 5/2010 |
| KR | 101027351 | B1 | 4/2011 |
| WO | 2004006008 | A1 | 1/2004 |

* cited by examiner

*Primary Examiner* — Temesgh Ghebretinsae
*Assistant Examiner* — Lisa Landis
(74) *Attorney, Agent, or Firm* — Cantor Colburn LLP

(57) ABSTRACT

A display apparatus includes a gate line, a first data line which receives a first data signal, a second data line which receives a second data signal having a gray scale lower than a gray scale of the first data signal and a polarity opposite to the first data signal, a short gate line which receives a short gate signal, and a plurality of pixels, each pixel including a first sub-pixel which displays a first image corresponding to the first data signal, a second sub-pixel which displays a second image corresponding to the second data signal, and a switching device which electrically connects the first sub-pixel and the second sub-pixel in response to the short gate signal. A pixel alternately displays a display image and a black image in a unit of at least one frame.

21 Claims, 13 Drawing Sheets

DISPLAY APPARATUS HAVING A SHORT GATE LINE AND METHOD OF DRIVING THE SAME

This application claims priority to Korean Patent Application No. 10-2012-0038079, filed on Apr. 12, 2012, and all the benefits accruing therefrom under 35 U.S.C. §119, the content of which in its entirety is herein incorporated by reference.

BACKGROUND

1. Field

Exemplary embodiments of the invention relate to a display apparatus capable of improving a display quality and a method of driving the same.

2. Description of the Related Art

A three-dimensional ("3D") image display apparatus provides a left-eye image and a right-eye image, which have a binocular disparity, to a left eye and a right eye of a viewer, respectively. Thus, the left-eye image and the right-eye image are provided to two eyes of the viewer, and then, transmitted to the viewer's brain. The viewer's brain mixes the left-eye image and the right-eye image with each other and perceives the 3D image.

A method using the binocular disparity occurring between the viewer's eyes is classified into a glass type method and a glassless type method. A glass type 3D image display apparatus alternately displays the left-eye image and the right-eye image and switches polarization properties of a light incident into polarization glasses to realize the 3D image.

SUMMARY

Embodiments of the disclosure provide a display apparatus capable of improving a display quality of a three-dimensional ("3D") image by inserting a black frame between image frames.

Exemplary embodiments of the invention provide a display apparatus which includes a gate line which receives a gate signal, a first data line which receives a first data signal, a second data line which receives a second data signal having a gray scale lower than a gray scale of the first data signal and a polarity opposite to a polarity of the first data signal, a short gate line which receives a short gate signal, and a plurality of pixels, each pixel including a first sub-pixel which is connected to the gate line and the first data line and displays a first image corresponding to the first data signal, a second sub-pixel which is connected to the gate line and the second data line and displays a second image corresponding to the second data signal, and a switching device which electrically connects the first sub-pixel and the second sub-pixel in response to the short gate signal. The each pixel alternately displays a display image and a black image in a unit of at least one frame.

Exemplary embodiments of the invention provide a display apparatus which includes a display panel including a pixel which displays a display image during an image frame and displays a black image during a black frame, the image frame and the black frame being alternately generated, the pixel including a first sub-pixel, a second sub-pixel, and a short circuit which electrically connects the first and second sub-pixels during the black frame, a gate driver which applies a gate signal to the first and second sub-pixels during the image frame, a data driver which applies a first data signal to the first sub-pixel during the image frame and applies a second data signal to the second sub-pixel during the image frame, the second data signal having a gray scale lower than a gray scale of the first data signal and a polarity opposite to a polarity of the first data signal, and a short gate driver which applies a short gate signal to the short circuit during the black frame and electrically connects the first sub-pixel and the second sub-pixel.

BRIEF DESCRIPTION OF THE DRAWINGS

The above and other advantages of the invention will become readily apparent by reference to the following detailed description when considered in conjunction with the accompanying drawings wherein.

DETAILED DESCRIPTION

Figure 1:
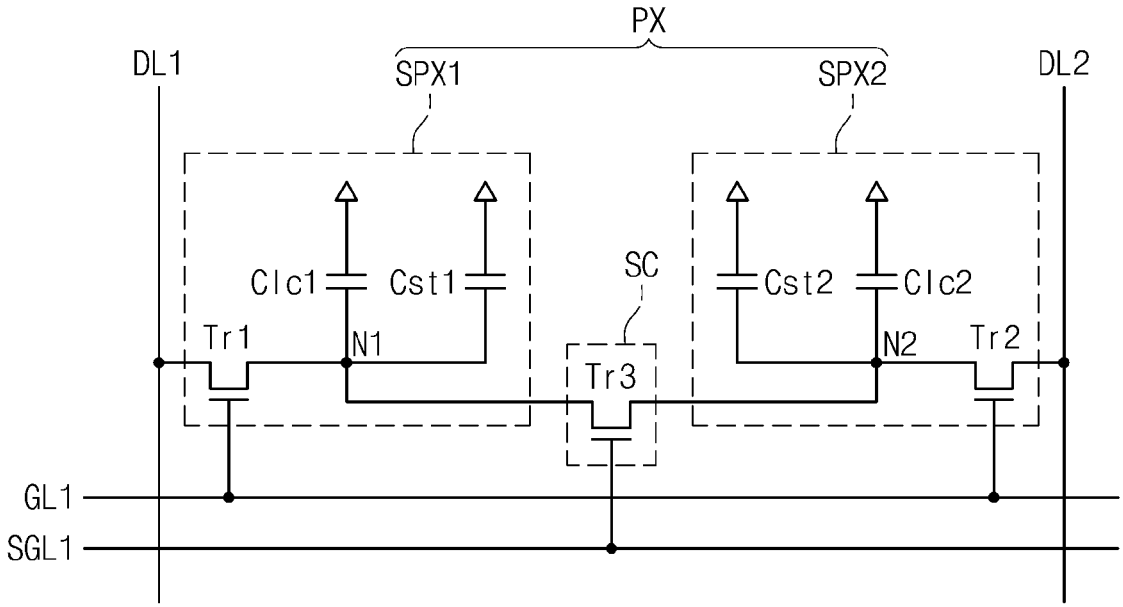
FIG. 1 is an equivalent circuit diagram showing an exemplary embodiment of a pixel included in a display apparatus according to of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is an equivalent circuit diagram showing an exemplary embodiment of a pixel included in a display apparatus according to the invention. The display apparatus includes a plurality of pixels PX, however, for the convenience of explanation, only one pixel PX is shown in FIG. 1.

Referring to FIG. 1, the pixel PX includes a first sub-pixel SPX1 and a second sub-pixel SPX2. The first sub-pixel SPX1 includes a first thin film transistor Tr1, a first liquid crystal capacitor Clc1, and a first storage capacitor Cst1, and the second sub-pixel SPX2 includes a second thin film transistor Tr2, a second liquid crystal capacitor Clc2, and a second storage capacitor Cst2.

The first and second sub-pixels SPX1 and SPX2 are disposed between two data lines, a first data line DL1 and a second data line DL2, which are adjacent to each other. The first and second sub-pixels SPX1 and SPX2 are respectively connected to the first and second data lines DL1 and DL2 and are commonly connected to a first gate line GL1.

In detail, the first thin film transistor Tr1 of the first sub-pixel SPX1 includes a first control electrode connected to the first gate line GL1, a first input electrode connected to the first data line DL1, and a first output electrode connected to the first liquid crystal capacitor Clc1. In addition, the second thin film transistor Tr2 of the second sub-pixel SPX2 includes a second control electrode connected to the first gate line GL1, a second input electrode connected to the second data line DL2, and a second output electrode connected to the second liquid crystal capacitor Clc2.

The first output electrode of the first thin film transistor Tr1 is connected to the first storage capacitor Cst1 and the second output electrode of the second thin film transistor Tr2 is connected to the second storage capacitor Cst2.

When a gate signal is applied to the first gate line GL1, the first and second thin film transistors Tr1 and Tr2 are substantially simultaneously turned on. A first data signal applied to the first data line DL1 is applied to the first liquid crystal capacitor Clc1 through the turned-on first thin film transistor Tr1, and a second data signal applied to the second data line DL2 is applied to the second liquid crystal capacitor Clc2 through the turned-on second thin film transistor Tr2.

The first data signal has a gray scale higher than an input gray scale and the second data signal has a gray scale lower than the input gray scale. The input gray scale may be a gray scale of an image signal including image information of each pixel PX, which is applied to the display apparatus.

A first sub-pixel electrode which serves as a first electrode of the first liquid crystal capacitor Clc1 receives the first data signal and a second sub-pixel electrode that serves as a first electrode of the second liquid crystal capacitor Clc2 receives the second data signal. In addition, a common electrode that serves as a second electrode of each of the first and second liquid crystal capacitors Clc1 and Clc2 receives a reference signal.

As an example, the first data signal has a first polarity with respect to the reference signal and the second data signal has a second polarity opposite to the first polarity with respect to the reference signal. That is, the polarity of each of the first and second data signals may be inverted at every sub-pixel.

Figure 2:
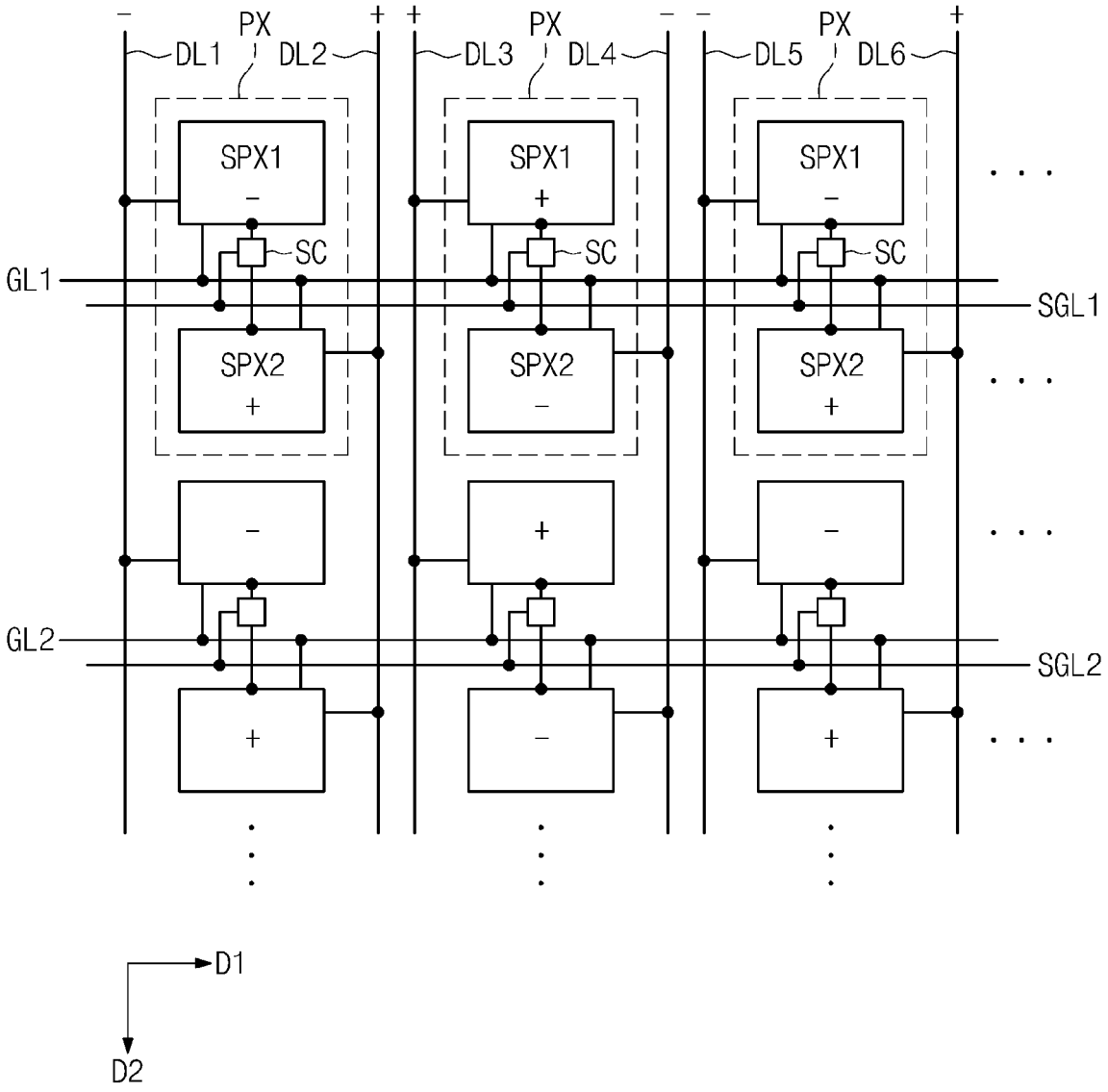
FIG. 2 is a plan view showing an exemplary embodiment of an array substrate on which the pixel shown in FIG. 1 is arranged.

FIG. 2 is a plan view showing an exemplary embodiment of an array substrate on which the pixel shown in FIG. 1 is arranged. FIG. 2 shows six pixels arranged in two rows by three columns as a representative example and the number of the pixels of the present invention should not be construed as limited to this.

Referring to FIG. 2, the first gate line GL1 connected to a first pixel row and the second gate line GL2 connected to a second pixel row extend in a first direction D1, and first, second, third, fourth, fifth, and sixth data lines DL1, DL2, DL3, DL4, DL5, and DL6 extend in a second direction D2 substantially perpendicular to the first direction D1.

The first and second sub-pixels SPX1 and SPX2 of each of the pixels arranged in the first pixel row are disposed at upper and lower sides with respect to the first gate line GL1, respectively, and the first and second sub-pixels SPX1 and SPX2 of each of the pixels arranged in the second pixel row are disposed at upper and lower sides with respect to the second gate line GL2.

A first pixel column is disposed between the first and second data lines DL1 and DL2, a second pixel column is disposed between the third and fourth data lines DL3 and DL4, and a third pixel column is disposed between the fifth and sixth data lines DL5 and DL6.

The first sub-pixels SPX1 of the first pixel column are connected to the first data line DL1 and the second sub-pixels SPX2 of the first pixel column are connected to the second data line DL2. The first sub-pixels SPX1 of the second pixel column are connected to the third data line DL3 and the second sub-pixels SPX2 of the second pixel column are connected to the fourth data line DL4. The first sub-pixels SPX1 of the third pixel column are connected to the fifth data line DL5 and the second sub-pixels SPX2 of the third pixel column are connected to the sixth data line DL6.

The first and second data lines DL1 and DL2 are respectively applied with first and second data signals having opposite polarities to each other, and the third and fourth data lines DL3 and DL4 are respectively applied with third and fourth data signals having opposite polarities to each other. As an example, when the first data signal has a negative (−) polarity, the second data signal has a positive (+) polarity. The third data signal has a polarity, e.g., the positive (+) polarity, which is the same as the second data signal and the fourth data signal has a polarity, e.g., the negative (−) polarity, which is opposite to the third data signal. In addition, fifth data signal has a polarity, e.g., the negative (−) polarity, which is the same as the fourth data signal and the sixth data signal has a polarity, e.g., the positive (+) polarity, which is opposite to the fifth data signal.

Thus, the polarity of a data signal is inverted at every sub-pixel in the first direction D1 and inverted at every sub-pixel in the second direction D2. Accordingly, a sub-dot inversion driving may be realized.

Although not shown in the figures, the polarity of the first to six data signals may be inverted at least every one frame.

Referring back to FIGS. 1 and 2, a first short gate line SGL1 is disposed between the first and second sub-pixels SPX1 and SPX2 in the first pixel row and substantially parallel to the first gate line GL1, and a second short gate line SGL2 is disposed between the first and second sub-pixels SPX1 and SPX2 in the second pixel row and substantially parallel to the second gate line GL2.

In addition, each pixel PX further includes a short circuit SC electrically connected to the first and second sub-pixels SPX1 and SPX2. The short circuit SC includes a short switching device Tr3. The short switching device Tr3 includes a third control electrode connected to the first short gate line SGL1, a third input electrode connected to the first output electrode of the first thin film transistor Tr1, and a third output electrode connected to the second output electrode of the second thin film transistor Tr2.

When a first short gate signal is applied to the first short gate line SGL1, the short switching device Tr3 is turned on to electrically connect the first output electrode of the first thin film transistor Tr1, i.e., a first node N1, and the second output electrode of the second thin film transistor Tr2, i.e., a second node N2.

As described above, the first and second sub-pixels SPX1 and SPX2 are respectively applied with the first and second data signals having the opposite polarities to each other. Therefore, when the first and second sub-pixels SPX1 and SPX2 are electrically connected to each other, each of the first node N1 of the first sub-pixel SPX1 and the second node N2 of the second sub-pixel SPX2 may have an average electric potential of the first and second data signals.

Figure 3A:
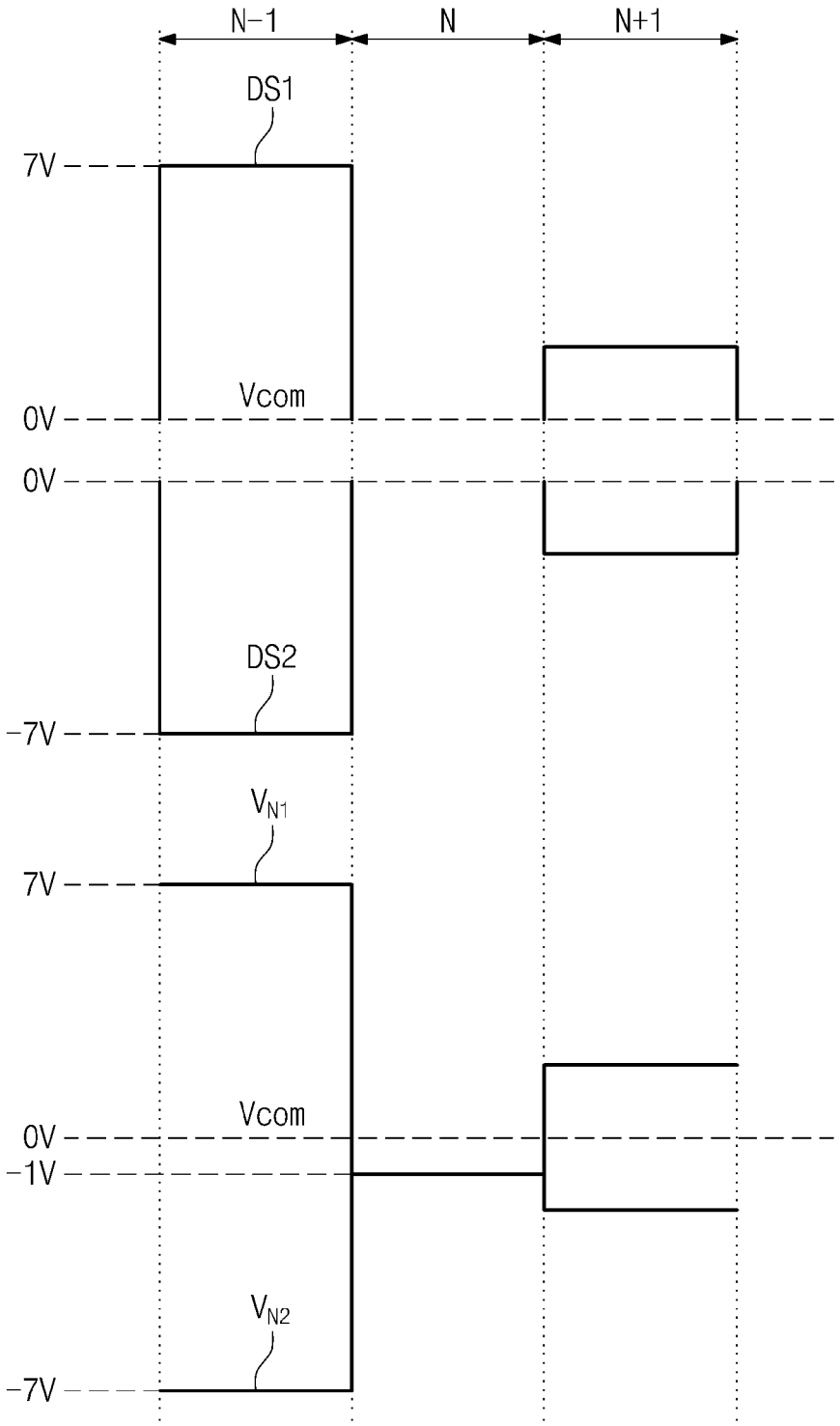
FIGS. 3A and 3B are waveform diagrams showing exemplary embodiments of electric potentials of first and second nodes of first and second sub-pixels, respectively.
Figure 3B:
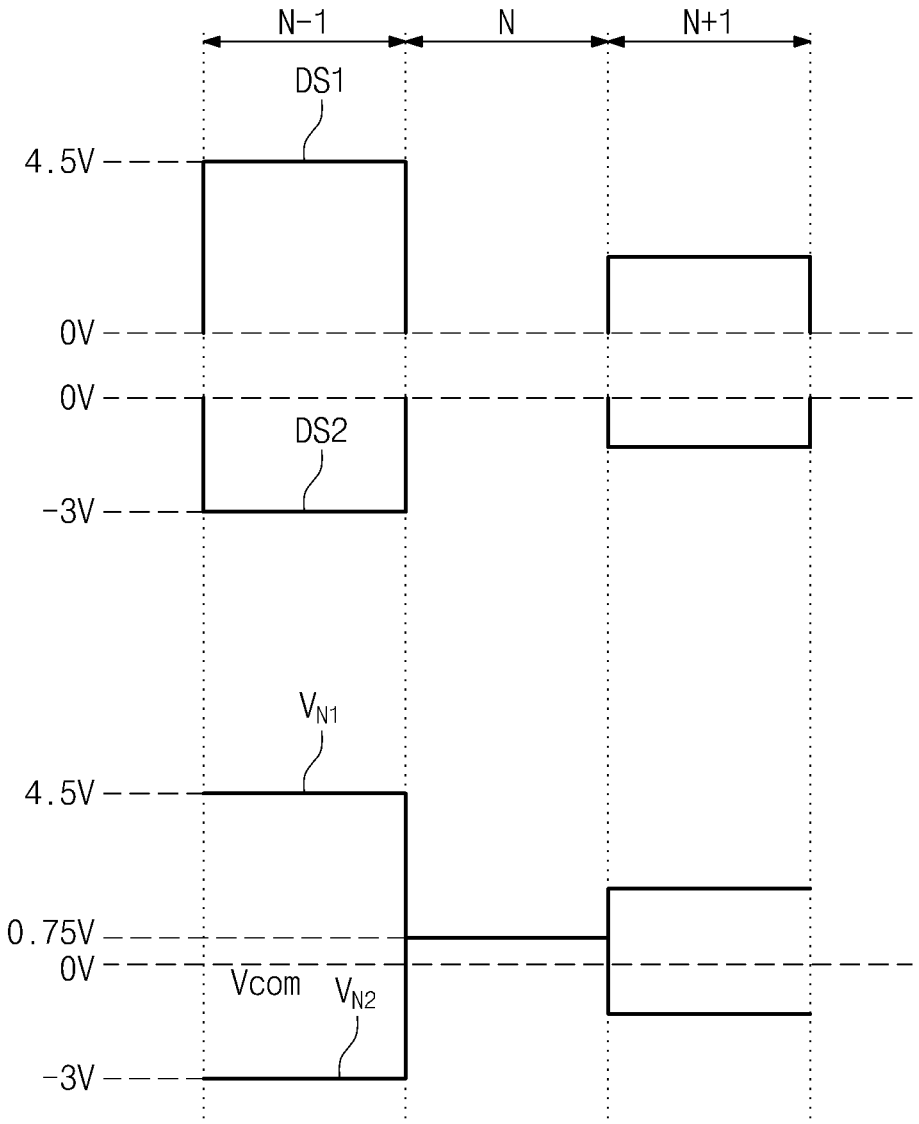

FIGS. 3A and 3B are waveform diagrams showing exemplary embodiments of electric potentials of the first and second nodes of first and second sub-pixels, respectively. In detail, FIG. 3A shows the electric potentials of the first and second nodes when a higher gray scale image is displayed in a previous frame N−1, and FIG. 3B shows the electric potentials of the first and second nodes when a lower gray scale image is displayed in a previous frame N−1.

Referring to FIG. 3A, a first data signal DS1 applied to the first sub-pixel SPX1 has the positive (+) polarity with respect to a reference signal Vcom and a second data signal DS2 applied to the second sub-pixel SPX2 has the negative (−) polarity with respect to the reference signal Vcom.

Referring to FIG. 3A, in a case where the first and second sub-pixels SPX1 and SPX2 respectively display the higher gray scale image in the previous frame N−1, the first and second data signals DS1 and DS2 may have substantially the same level with respect to the reference signal Vcom. That is, in an exemplary embodiment, when the reference signal Vcom corresponding to zero volts, the first sub-pixel SPX1 is charged with the first data signal DS1 corresponding to about 7 volts and the second sub-pixel SPX2 is charged with the second data signal DS2 corresponding to about −7 volts.

In a present frame N, the first and second data signals DS1 and DS2 are not applied to the first and second sub-pixels SPX1 and SPX2. However, when the short switching device Tr3 is turned on in response to the first short gate signal, the first output electrode of the first thin film transistor Tr1 and the second output electrode of the second thin film transistor Tr2 are electrically connected to each other.

Accordingly, in an exemplary embodiment, an electric potential $V_{N1}$ of the first node N1 is decreased to zero volts by the second data signal DS2 charged in the second sub-pixel SPX2 during the previous frame N−1 and an electric potential $V_{N2}$ of the second node N2 is increased to zero volts by the first data signal DS1 charged in the first sub-pixel SPX1 during the previous frame N−1. That is, in a case where the first and second sub-pixels SPX1 and SPX2 have the same size, the electric potentials $V_{N1}$ and $V_{N2}$ of the first and second nodes N1 and N2 may have an average voltage value of the first and second data signals DS1 and DS2.

However, in a case where the first and second sub-pixels SPX1 and SPX2 have different sizes from each other, e.g., an area of the second sub-pixel SPX2 is greater than an area of the first sub-pixel SPX1, the electric potentials $V_{N1}$ and $V_{N2}$ of the first and second nodes N1 and N2 may be lower than an average electric potential thereof, e.g., −1 volts, as shown in FIG. 3A, in the present frame N.

As described above, when the first and second sub-pixels SPX1 and SPX2 are electrically connected to each other in the present frame N, the electric potentials $V_{N1}$ and $V_{N2}$ of the first and second nodes N1 and N2 become close to the reference signal Vcom. Thus, the first and second sub-pixels SPX1 and SPX2 may display a black gray-scale image in the present frame N.

When the short switching device Tr3 is turned off in a next frame N+1, the first and second sub-pixels SPX1 and SPX2 are electrically disconnected from each other. Accordingly, the first data signal DS1 is applied to the first sub-pixel SPX1 and the second data signal DS2 is applied to the second sub-pixel SPX2. As a result, a desired image may be displayed in the next frame N+1.

In an exemplary embodiment, a frame (hereinafter, referred to as a black frame) in which the black gray-scale image is displayed may be disposed between frames (hereinafter, referred to as normal frames) in which a normal image is displayed. That is, the display apparatus may alternately display the black frame and the normal frame.

Referring to FIG. 3B, the first data signal DS1 applied to the first sub-pixel SPX1 has the positive (+) polarity with respect to the reference signal Vcom and the second data signal DS2 applied to the second sub-pixel SPX2 has the negative (−) polarity with respect to the reference signal Vcom.

Referring to FIG. 3B, in a case where the first and second sub-pixels SPX1 and SPX2 respectively display the lower gray scale image in the previous frame N−1, the first sub-pixel SPX1 is charged with the first data signal DS1 corresponding to about 4.5 volts and the second sub-pixel SPX2 is charged with the second data signal DS2 corresponding to about −3 volts. As described above, since the first data signal DS1 has the gray scale higher than the input gray scale and the second data signal DS2 has the gray scale lower than the input gray scale, an absolute value of the first data signal DS1 with respect to the reference signal Vcom is greater than an absolute value of the second data signal DS2 with respect to the reference signal Vcom.

Then, in the present frame N, the first and second data signals DS1 and DS2 are not applied to the first and second sub-pixels SPX1 and SPX2. However, when the short switching device Tr3 is turned on in response to the first short gate signal, the first output electrode of the first thin film transistor Tr1 and the second output electrode of the second thin film transistor Tr2 are electrically connected to each other.

Accordingly, in an exemplary embodiment, the electric potential $V_{N1}$ of the first node N1 is decreased by the second data signal DS2 charged in the second sub-pixel SPX2 during the previous frame N−1 and the electric potential $V_{N2}$ of the second node N2 is increased by the first data signal DS1 charged in the first sub-pixel SPX1 during the previous frame N−1. That is, in a case where the first and second sub-pixels SPX1 and SPX2 have the same size, the electric potentials $V_{N1}$ and $V_{N2}$ of the first and second nodes N1 and N2 may have an average voltage value of the first and second data signals DS1 and DS2, e.g., about 0.75 volts, as shown in FIG. 3B.

However, in a case where the first and second sub-pixels SPX1 and SPX2 have different sizes from each other, e.g., the area of the second sub-pixel SPX2 is greater than the area of the first sub-pixel SPX1, the electric potentials $V_{N1}$ and $V_{N2}$ of the first and second nodes N1 and N2 may be lower than the average electric potential, i.e., zero volts.

As described above, when the first and second sub-pixels SPX1 and SPX2 are electrically connected to each other in the present frame N, the electric potentials $V_{N1}$ and $V_{N2}$ of the first and second nodes N1 and N2 become close to the reference signal Vcom. Thus, the first and second sub-pixels SPX1 and SPX2 may display the black gray-scale image in the present frame N.

When the short switching device Tr3 is turned off in the next frame N+1, the first and second sub-pixels SPX1 and SPX2 are electrically disconnected from each other. Accordingly, the first data signal DS1 is applied to the first sub-pixel SPX1 and the second data signal DS2 is applied to the second sub-pixel SPX2. As a result, the desired image may be displayed in the next frame N+1 again.

Figure 4:
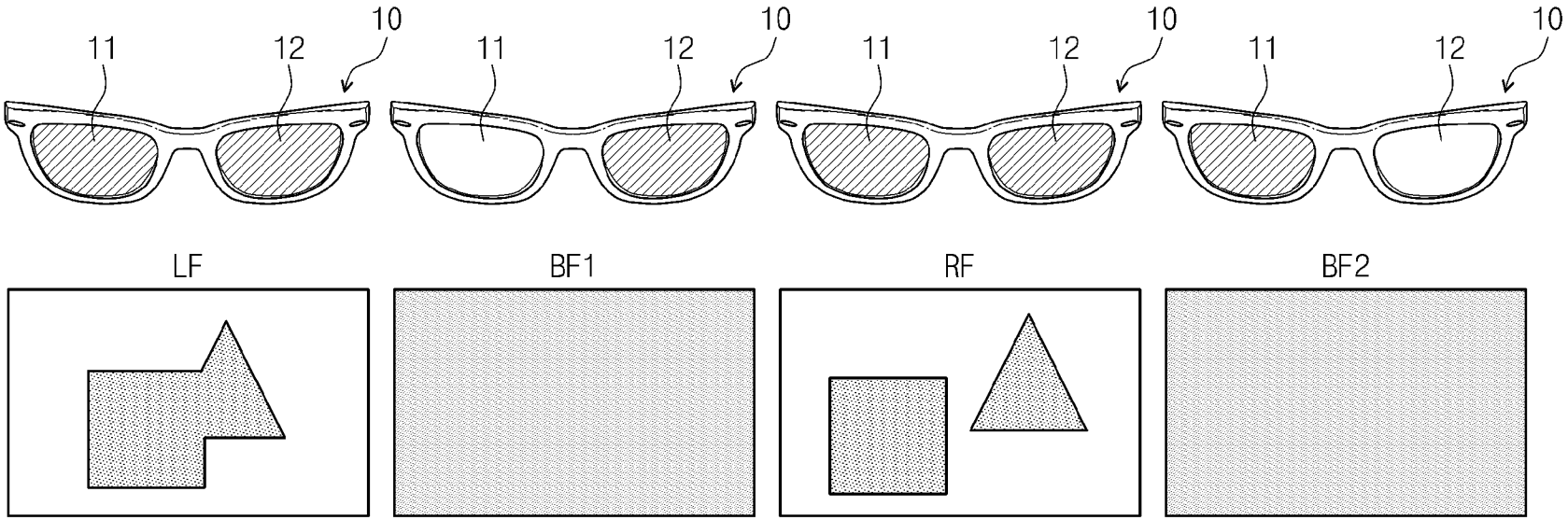
FIG. 4 is a view showing an exemplary embodiment of an operation of shutter glasses and an image of each frame, which is displayed on a display apparatus.

FIG. 4 is a view showing an exemplary embodiment of an operation of shutter glasses and an image of each frame, which is displayed on a display apparatus.

Referring to FIG. 4, a three-dimensional ("3D") image display apparatus includes a shutter glasses 10 operated in synchronization with the frame. The shutter glasses 10 include a left-eye shutter 11 and a right-eye shutter 12.

The 3D image display apparatus displays a left-eye image during a left-eye image frame LF and a right-eye image during a right-eye image frame RF. In addition, black frames BF1 and BF2 may be inserted between the left-eye image frame LF and the right-eye image frame RF to substantially prevent the left-eye image frame LF and the right-eye image frame RF from being overlapped with each other.

The left-eye shutter 11 and the right-eye shutter 12 of the shutter glasses 10 are closed during the left-eye image frame LF, and the left-eye shutter 11 of the shutter glasses 10 is opened during the first black frame BF1 following the left-eye image frame LF. Accordingly, a viewer may perceive the left-eye image displayed during the left-eye image frame LF through a left eye.

Then, the left-eye shutter 11 and the right-eye shutter 12 of the shutter glasses 10 are closed during the right-eye image frame RF, and the right-eye shutter 12 of the shutter glasses 10 is opened during the second black frame BF2 following the right-eye image frame RF. Accordingly, the viewer may perceive the right-eye image displayed during the right-eye image frame RF through a right eye.

In this case, the first short gate signal is applied to the first short gate line SGL1 during the first and second black frames BF1 and BF2 to operate the short switching device Tr3. Thus, the first and second sub-pixels SPX1 and SPX2 are electrically connected to each other during the first and second black frames BF1 and BF2, and thus the black gray-scale image is displayed.

That is, the 3D image display apparatus may employ the pixel PX including the short circuit SC in order to realize the first and second black frames BF1 and BF2.

Figure 5:
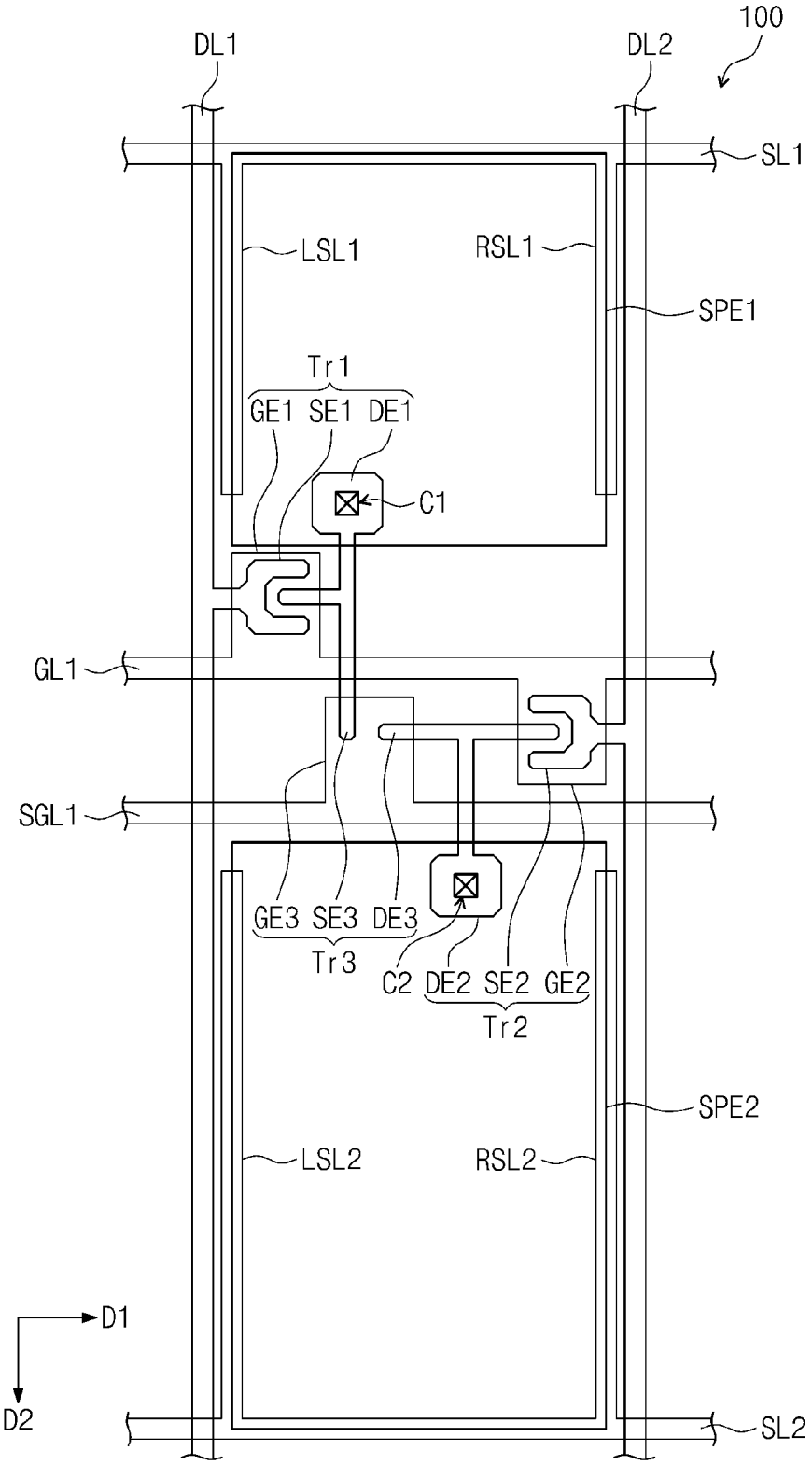
FIG. 5 is a plan view showing an exemplary embodiment of a display panel according to of the invention.

FIG. 5 is a plan view showing an exemplary embodiment of a display panel according to the invention. Specifically, FIG. 5 shows a pixel arranged on the display panel 100, which includes a first substrate and a second substrate (not shown) facing each other with a liquid crystal layer interposed therebetween.

Referring to FIG. 5, the first gate line GL1 and the first short gate line SGL1 are disposed on the first substrate to extend in the first direction D1, and the first and second data lines DL1 and DL2 are disposed on the first substrate to extend in the second direction D2.

The first sub-pixel SPX1 is positioned at an upper side with respect to the first gate line GL1 and the second sub-pixel SPX2 is positioned at a lower side with respect to the first gate line GL1.

The first sub-pixel SPX1 includes the first thin film transistor Tr1, a first sub-pixel electrode SPE1, a first storage line SL1, and first and second sub-storage lines LSL1 and RSL1.

The first thin film transistor Tr1 includes a first control electrode GE1 branched from the first gate line GL1, a first input electrode SE1 branched from the first data line DL1, and a first output electrode DE1 spaced apart from the first input electrode SE1 by a predetermined distance and disposed above the first control electrode GE1. The first output electrode DE1 may be electrically connected to the first sub-pixel electrode SPE1 through a first contact hole C1.

The first sub-pixel electrode SPE1 is partially overlapped with the first storage line SL1 and the first and second sub-storage lines LSL1 and RSL1 to form the first storage capacitor Cst1 shown in FIG. 1.

In an exemplary embodiment, the first storage line SL1 extends in the first direction D1 and the first and second sub-storage lines LSL1 and RSL1 extend from the first storage line SL1 toward the second direction D2.

Meanwhile, the second sub-pixel SPX2 includes the second thin film transistor Tr2, a second sub-pixel electrode SPE2, a second storage line SL2, and third and fourth sub-storage lines LSL2 and RSL2.

The second thin film transistor Tr2 includes a second control electrode GE2 branched from the first gate line GL1, a second input electrode SE2 branched from the second data line DL2, and a second output electrode DE2 spaced apart from the second input electrode SE2 by a predetermined distance and disposed above the second control electrode GE2. The second output electrode DE2 may be electrically connected to the second sub-pixel electrode SPE2 through a second contact hole C2.

The second sub-pixel electrode SPE2 is partially overlapped with the second storage line SL2 and the third and fourth sub-storage lines LSL2 and RSL2 to form the second storage capacitor Cst2 shown in FIG. 1.

In an exemplary embodiment, the second storage line SL2 extends in the first direction D1 and the third and fourth sub-storage lines LSL2 and RSL2 extend from the second storage line SL2 toward the second direction D2.

The short circuit SC shown in FIG. 1 includes the short switching device Tr3. The short switching device Tr3 includes a third control electrode GE3 branched from the first short gate line SGL1, a third input electrode SE3 connected to the first output electrode DE1 of the first thin film transistor Tr1, and a third output electrode DE3 connected to the second output electrode DE2 of the second thin film transistor Tr2. The third input electrode SE3 and the third output electrode DE3 are disposed above the third control electrode GE3 and spaced apart from each other.

A detailed description of the operation of the first and second sub-pixels SPX1 and SPX2 and the short circuit SC will be omitted since it has already been described in detail with reference to FIGS. 1 to 4.

In addition, FIG. 5 shows the layout of the pixel PX shown in FIG. 1 according to the exemplary embodiment, however, it should be noted that the layout of the pixel PX of the invention is not limited to the layout shown in FIG. 5.

Figure 6:
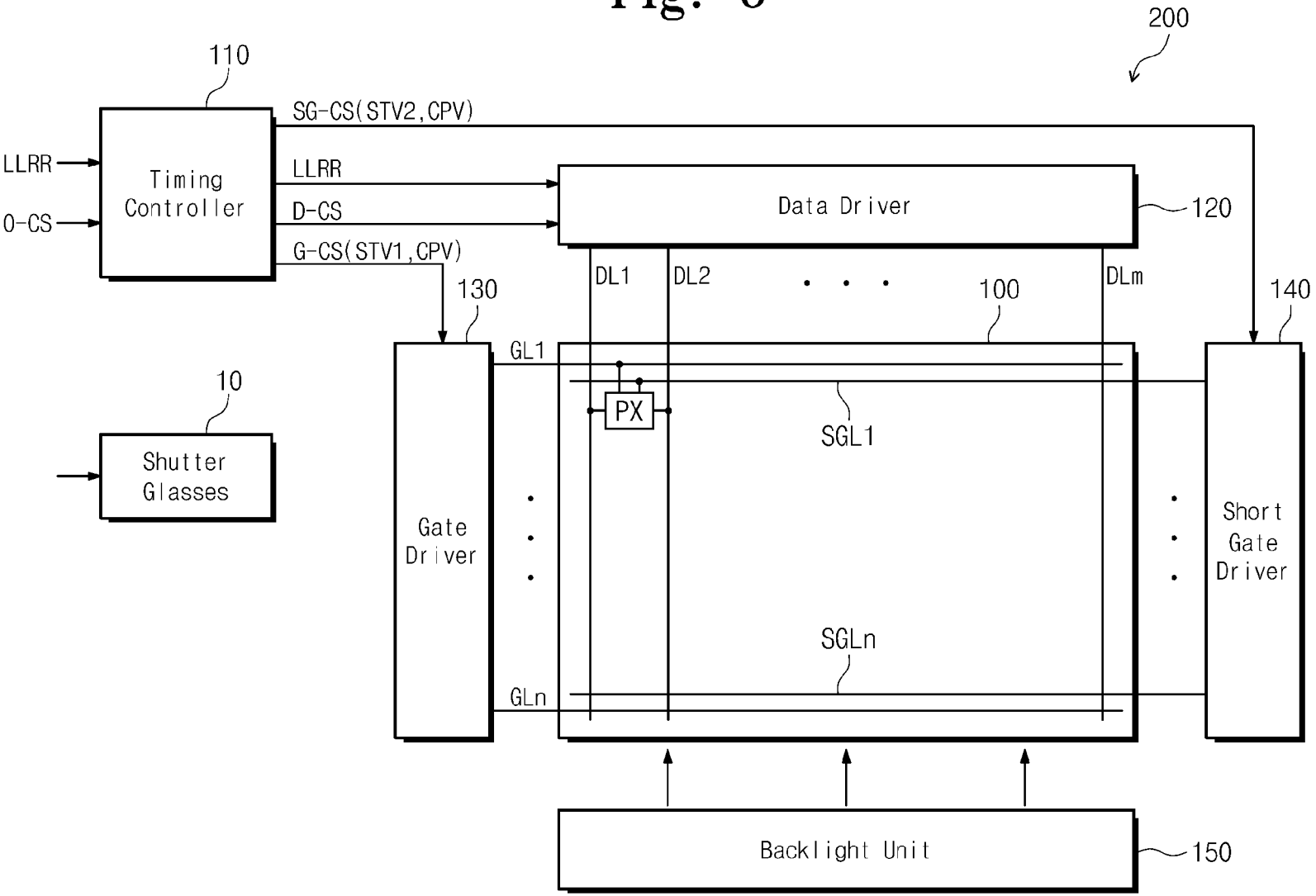
FIG. 6 is a block diagram showing an exemplary embodiment of a three-dimensional ("3D") image display apparatus according to the invention.
Figure 7:
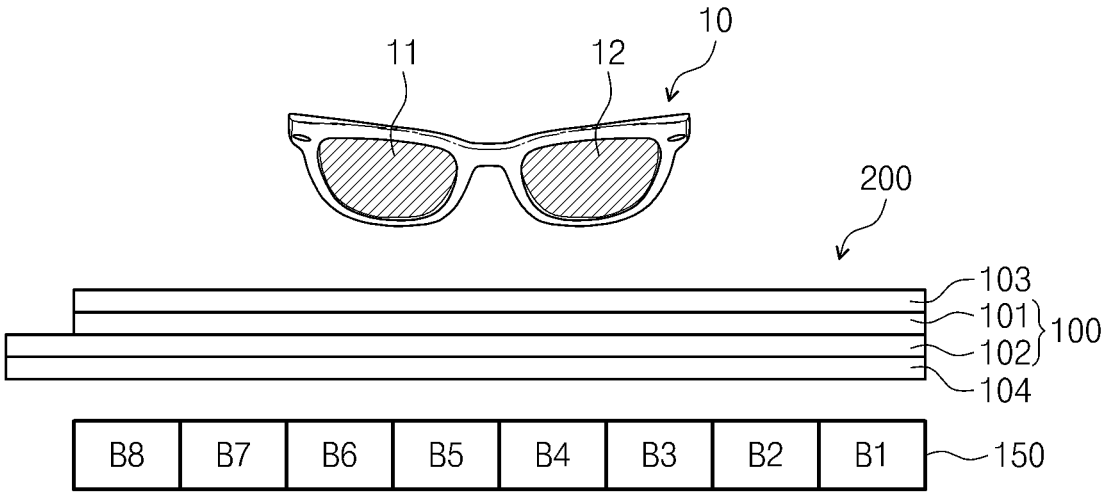
FIG. 7 is a cross-sectional view of the 3D image display apparatus shown in FIG. 6.

FIG. 6 is a block diagram showing an exemplary embodiment of a 3D image display apparatus according to the invention and FIG. 7 is a cross-sectional view of the 3D image display apparatus shown in FIG. 6.

Referring to FIG. 6, a 3D image display apparatus 200 includes a display panel 100 that displays an image, a data driver 120 and a gate driver 130 that drive the display panel 100, and a timing controller 110 that controls the data driver 120 and the gate driver 130. Although not shown in FIG. 6, the display apparatus 200 may further include a repeater, a frame rate converter, and a frame memory.

The repeater receives a two-dimensional ("2D") image signal from a video system (not shown) and transmits the 2D image signal to the frame rate converter.

The frame rate converter converts the 2D image signal from the repeater to a 3D image signal. In addition, the frame rate converter converts a frame rate of the 3D image signal to a frame rate appropriate to the display panel 100. In an exemplary embodiment, the frame rate converter separates the 2D image signal having a frequency of about 60 Hz into a left-eye image data L and a right-eye image data R to generate the 3D image signal and converts the 3D image signal to a quadruple-speed image signal LLRR having a frequency of about 240 Hz.

Meanwhile, the timing controller 110 receives the quadruple-speed image signal LLRR from the frame rate converter and receives a control signal O-CS from the repeater. The control signal O-CS includes a main clock signal, a vertical synchronization signal, a horizontal synchronization signal, and a data enable signal.

Based on the control signal O-CS, the timing controller 110 generates a data control signal D-CS to control an operation of the data driver 120 and a gate control signal G-CS to control an operation of the gate driver 130. The gate control signal G-CS and the data control signal D-CS are respectively applied to the gate driver 130 and the data driver 120.

The display panel 100 includes a plurality of gate lines GL1 to GLn receiving the gate signal, a plurality of data lines DL1 to DLm receiving the data signal, and a plurality of short gate lines SGL1 to SGLn receiving the short gate signal. The display panel 100 includes a plurality of pixel areas and each pixel area includes the pixel PX formed therein. A structure of the pixel PX has been described with reference to FIGS. 1 to 5, and thus a detailed description of the pixel PX will be omitted.

The 3D image display apparatus 200 further includes a short gate driver 140 to apply the short gate signal to the short gate lines SGL1 to SGLn. The timing controller 110 generates a short gate control signal SG-CS using the control signal O-CS to drive the short gate driver 140 and applies the short gate control signal SG-CS to the short gate driver 140.

Meanwhile, the data driver 120 receives the quadruple-speed image signal LLRR from the timing controller 110 and converts the quadruple-speed image signal LLRR to a left-eye data signal and a right-eye data signal in response to the data control signal D-CS to apply the left-eye data signal and the right-eye data signal to the display panel 100.

The 3D image display apparatus 200 is operated at a quadruple speed when displaying the 3D image. In detail, the 3D image display apparatus 200 divides one frame, in which the 2D image is displayed at 60 Hz, into four frames. Then, the 3D image display apparatus 200 displays the left-eye image during a first frame (i.e., the left-eye image frame) using the left-eye data signal, displays the black gray-scale image during a second frame (i.e., the first black frame), displays the right-eye image during a third frame (i.e., the right-eye image frame) using the right-eye data signal, and displays the black gray-scale image during a fourth frame (i.e., the second black frame).

During the left-eye image frame, the data driver 120 provides the left-eye data signal to the data lines DL1 to DLm of the display panel 100. In a case where each pixel PX includes the first and second sub-pixels SPX1 and SPX2, the left-eye data signal may be divided into a first left-eye data signal applied to the first sub-pixel SPX1 and a second left-eye data signal applied to the second sub-pixel SPX2. In this case, the first and second left-eye data signals have opposite polarities to each other.

During the right-eye image frame, the data driver 120 provides the right-eye data signal to the data lines DL1 to DLm of the display panel 100. In a case where each pixel PX includes the first and second sub-pixels SPX1 and SPX2, the right-eye data signal may be divided into a first right-eye data signal applied to the first sub-pixel SPX1 and a second right-eye data signal applied to the second sub-pixel SPX2. In this case, the first and second right-eye data signals have opposite polarities to each other.

In an exemplary embodiment, the data driver 120 does not provide the data signal to the data lines DL1 to DLm of the display panel 100 during the first and second black frames.

The gate driver 130 is electrically connected to the gate lines GL1 to GLn of the display panel 100 to apply the gate signal to the gate lines GL1 to GLn. In detail, the gate driver 130 generates the gate signals used to drive the gate lines GL1 to GLn on the basis of the gate control signal G-CS and sequentially output the gate signals to the gate lines GL1 to GLn. The gate control signal G-CS includes a first vertical start signal STV1 that starts an operation of the gate driver 130 and a gate clock signal CPV that determines an output timing of the gate signals.

In an exemplary embodiment, the gate driver 130 sequentially applies the gate signals to the gate lines GL1 to GLn during the left-eye image frame and sequentially applies the gate signals to the gate lines GL1 to GLn during the right-eye image frame. That is, the gate driver 130 turns on each pixel PX to allow each pixel to display the left-eye image during the left-eye image frame and turns on each pixel PX to allow each pixel to display the right-eye image during the right-eye image frame. However, the gate driver 130 is not operated during the first and second black frame periods.

The short gate driver 140 is electrically connected to the short gate lines SGL1 to SGLn disposed on the display panel 100 and provides the short gate signal to the short gate lines SGL1 to SGLn in response to the short gate control signal SG-CS from the timing controller 110. The short gate control signal SG-CS includes a second vertical start signal STV2 that starts operating the short gate driver 140 and the gate clock signal CPV that determines an output timing of the short gate signal.

The short gate driver 140 sequentially applies the short gate signal to the short gate lines SGL1 to SGLn during each of the first and second black frames. Accordingly, the short switching device Tr3 of each pixel PX is operated during each of the first and second black frames to allow the first and second data signals applied to the first and second sub-pixels SPX1 and SPX2 to have the electric potential corresponding to a black gray scale level. Therefore, the first and second sub-pixels SPX1 and SPX2 of each pixel PX may display the black gray-scale image during the first and second black frames.

As shown in FIG. 7, the 3D image display apparatus 200 further includes a backlight unit 150 disposed under the display panel 100 to provide light to the display panel 100. The backlight unit 150 includes a plurality of blocks, which are independently driven.

In an exemplary embodiment, the backlight unit 150 includes eight blocks (hereinafter, referred to as first to eighth blocks B1 to B8). In the backlight unit 150, the first to eighth blocks B1 to B8 are arranged in the same direction as a direction in which the gate lines GL1 to GLn are scanned.

In addition, the first to eighth blocks B1 to B8 of the backlight unit 150 may be driven in synchronization with a time point at which the gate signals are applied to the gate lines GL1 to GLn. A driving timing of each of the first to eighth blocks B1 to B8 will be described in detail with reference to FIG. 13 later.

The 3D image display apparatus 200 further includes the shutter glasses 10 to observe the image displayed on the display panel 100.

The shutter glasses 10 include the left-eye shutter 11 and the right-eye shutter 12. The shutter glasses 10 alternately drive the left-eye shutter 11 and the right-eye shutter 12 to allow the viewer to perceive the left-eye image through the left eye and the right-eye image through the right eye.

In an exemplary embodiment, the 3D image display apparatus 200 may further include a first polarizing plate 103 disposed on an upper surface of a first substrate 101 of the display panel 100 and a second polarizing plate 104 disposed on a lower surface of a second substrate 102 of the display panel 100. The first polarizing plate 103 may have a polarizing axis substantially perpendicular to a polarizing axis of the second polarizing plate 104.

Figure 8:
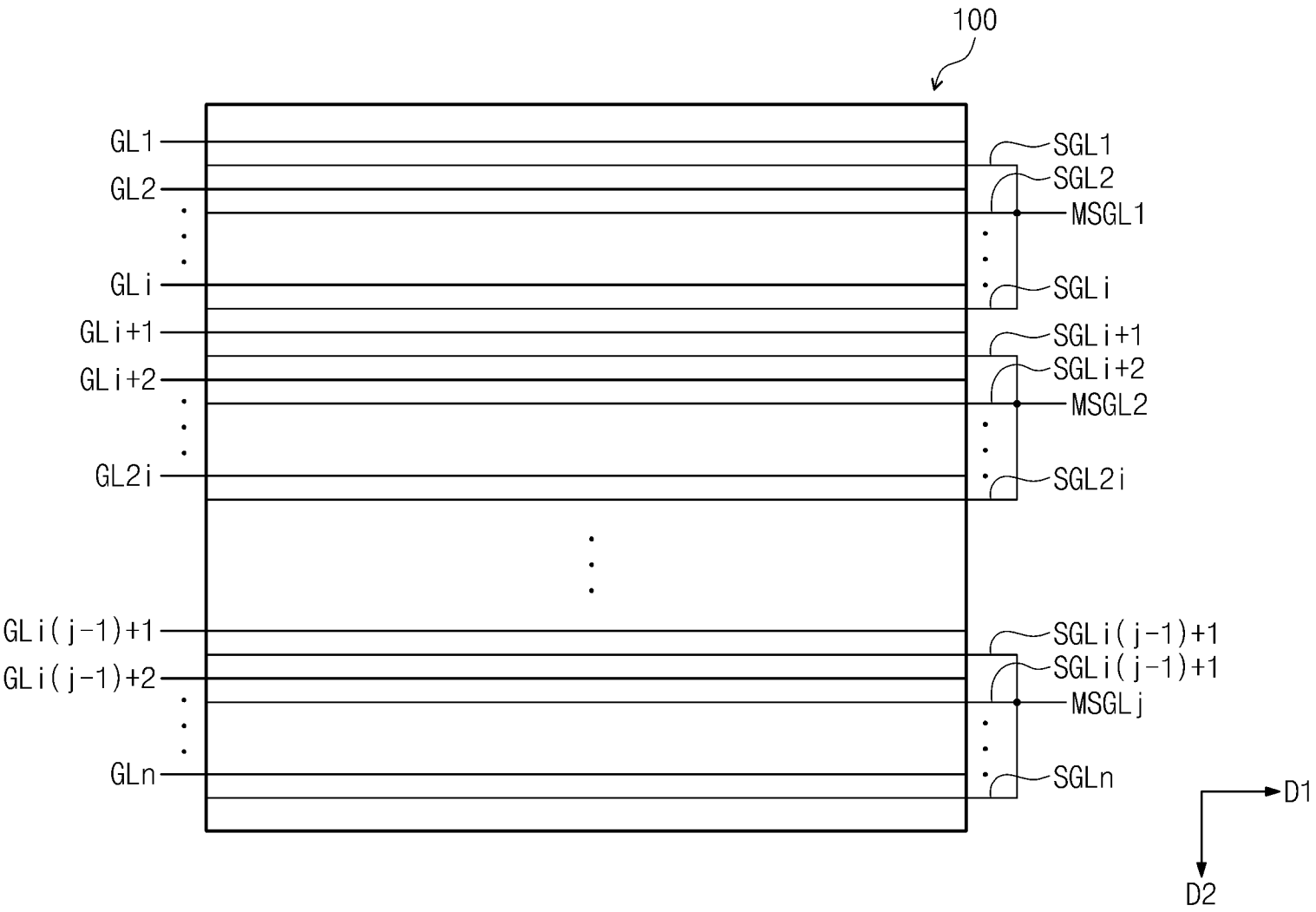
FIG. 8 is a plan view of gate lines and short gate lines shown in FIG. 6.

FIG. 8 is a plan view of gate lines and short gate lines shown in FIG. 6.

Referring to FIG. 8, the gate lines GL1 to GLn extend in the first direction D1 and arranged in the second direction D2 to be substantially parallel to each other.

The short gate lines SGL1 to SGLn extend in the first direction D1 and arranged in the second direction D2 to be substantially parallel to each other. Each of the short gate lines SGL1 to SGLn is disposed between two gate lines adjacent to each other. In an exemplary embodiment, the first short gate line SGL1 is disposed between the first and second gate lines GL1 and GL2.

The short gate lines SGL1 to SGLn may be divided into j number of groups MSGL1 to MSGLj. Each group MSGL1 to MSGLj includes i number of the short gate lines, and the number of the short gate lines included in the same group are electrically connected to each other. Accordingly, a total number (n) of the short gate lines SGL1 to SGLn is equal to i multiplied by j.

The short gate driver 140 shown in FIG. 6 is electrically connected to the j number of groups MSGL1 to MSGLj to sequentially apply the short gate signal to the j number of groups MSGL1 to MSGLj. Thus, the short gate lines SGL1 to SGLn may be sequentially driven in a unit of i short gate lines.

In a case where the gate signal has a high period substantially the same as that of the short gate signal, a time period required to drive the short gate lines SGL1 to SGLn may be reduced to 1/i times of a time period required to drive the gate lines GL1 to GLn.

Since the short gate lines SGL1 to SGLn are driven during the first and second black frames, a width of the first and second black frames may be controlled by adjusting a value of j.

In addition, a width of the first and second black frames may be controlled by adjusting the width of a high period of the short gate signal with respect to a width of the high period of the gate signal.

Figure 9:
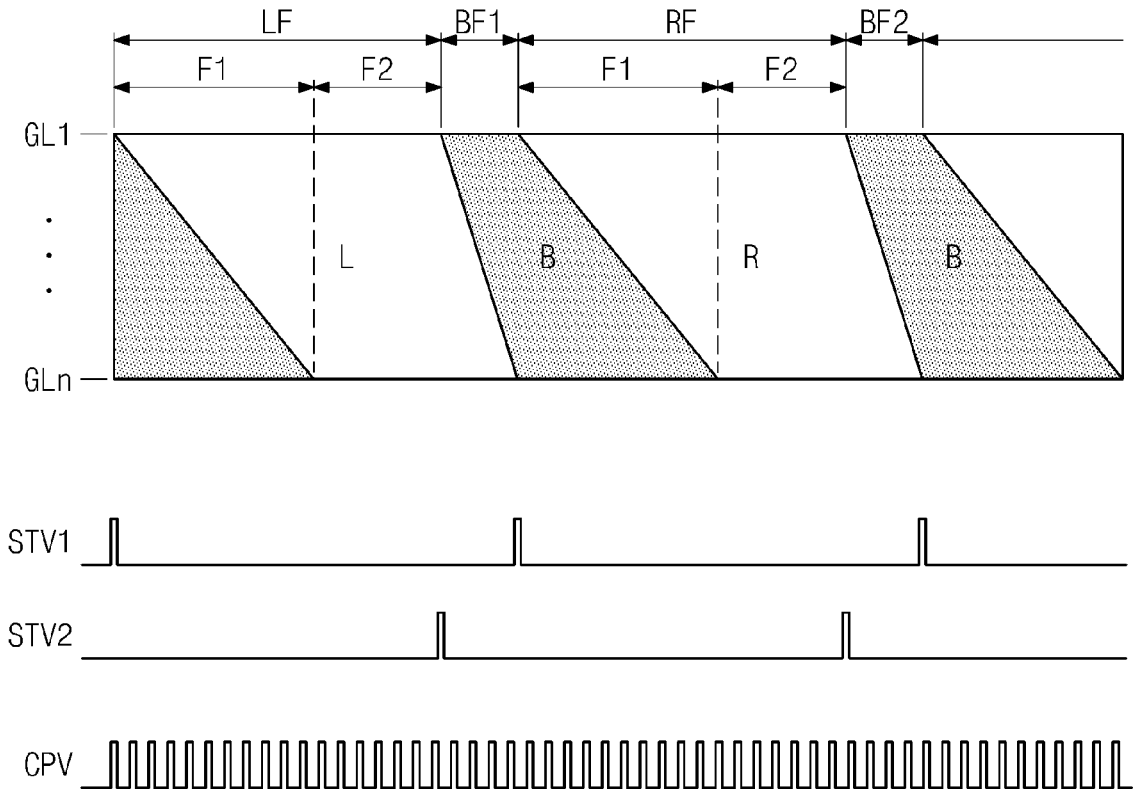
FIG. 9 is a view showing an exemplary embodiment of four successive frames, a gate clock signal, and first and second vertical start signals.

FIG. 9 is a view showing an exemplary embodiment of four successive frames, the gate clock signal, and the first and second vertical start signals.

Referring to FIG. 9, the left-eye image frame LF, the first black frame BF1, the right-eye image frame RF, and the second black frame BF2 are sequentially represented.

A first period F1 of the left-eye image frame LF is a period in which the gate lines GL1 to GLn are scanned, and a second period F2 of the left-eye image frame LF is a period in which the left-eye image is maintained. A first period F1 of the right-eye image frame RF is a period in which the gate lines GL1 to GLn are scanned, and a second period F2 of the right-eye image frame RF is a period in which the right-eye image is maintained. When the 3D image display apparatus is operated at the frequency of about 240 Hz, the first period F1 has a time width of about 4.17 ms.

The short gate lines SGL1 to SGLn are scanned in the first and second black frames BF1 and BF2. As shown in FIG. 8, when the short gate lines SGL1 to SGLn are grouped into the j number of groups, each of which has the i number of the short gate lines, the first and second black frames BF1 and BF2 may have a period of about 1/i times of a period of the left-eye image frame LF or the right-eye image frame RF.

As shown in FIG. 9, the first vertical start signal STV1 that indicates the start of the operation of the gate driver 130, as shown in FIG. 6, is generated in a high state at a start time point of the left-eye image frame LF and a start time point of the right-eye image frame RF. Accordingly, the gate driver 130 sequentially outputs the gate signal from the start time point of the left-eye image frame LF or the start time point of the right-eye image frame RF in response to the gate clock signal CPV.

The second vertical start signal STV2 that indicates the start of the operation of the short gate driver 140 is generated in a high state at the start time point of the first black frame BF1 and the start time point of the second black frame BF2. Accordingly, the short gate driver 140 sequentially outputs the short gate signal to the j number of groups MSGL1 to MSGLj from the start time point of the first black frame BF1 or the start time point of the second black frame BF2 in response to the gate clock signal CPV.

As shown in FIG. 9, a frequency of the gate clock signal CPV is constantly maintained during the four successive frames, and thus the high period of the short gate signal may have the same width as the high period of the gate signal.

FIG. 9 shows the four successive frames, the gate clock signal CPV, and the first and second vertical start signals STV1 and STV2 when the short gate driver 140 has the same driving frequency as a driving frequency of the gate driver 130. However, in an alternative exemplary embodiment, a driving frequency of the short gate driver 140 may be greater than the driving frequency of the gate driver 130.

Figure 10:
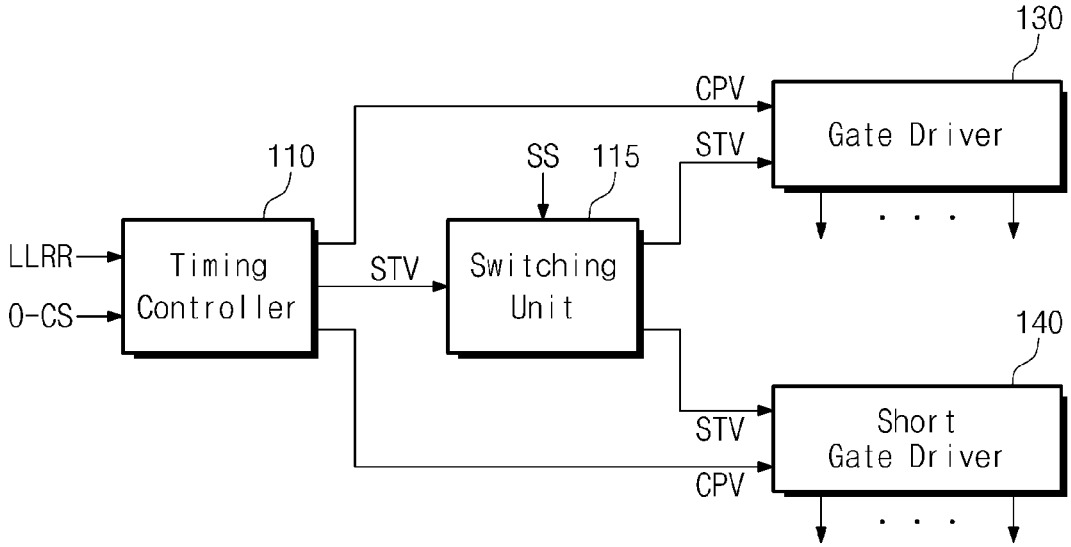
FIG. 10 is a block diagram showing another exemplary embodiment of a 3D image display apparatus according to the invention.
Figure 11:
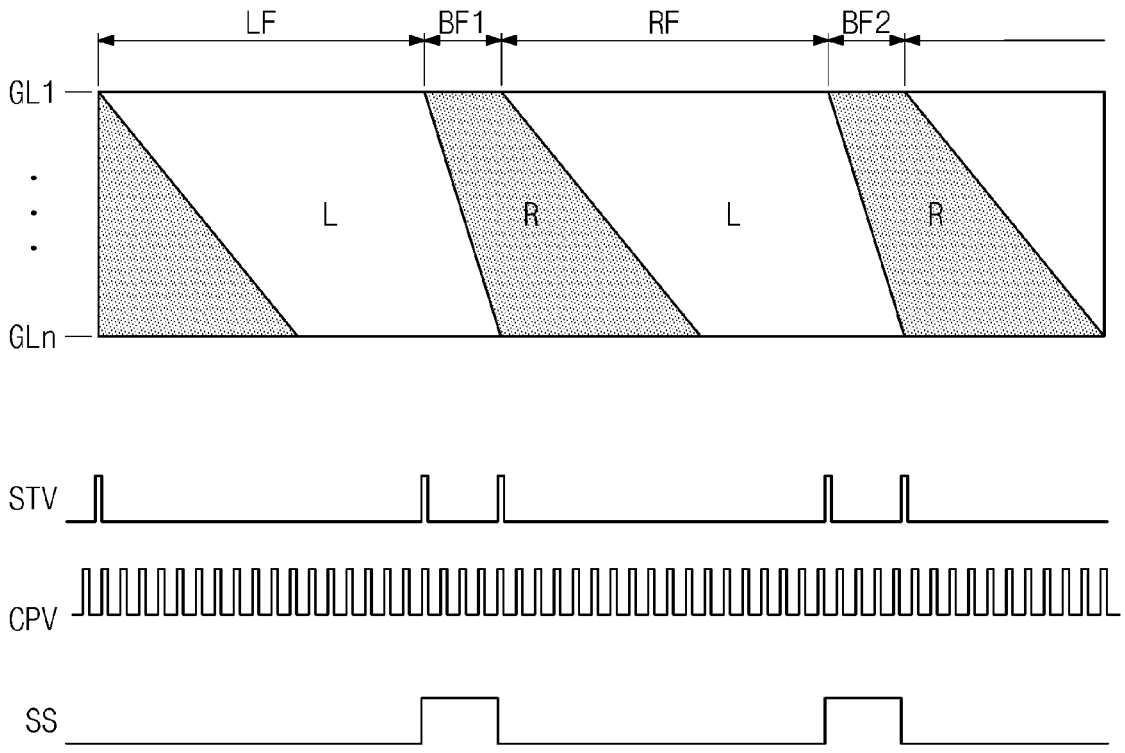
FIG. 11 is a view showing another exemplary embodiment of four successive frames, a gate clock signal, and a vertical start signal.

FIG. 10 is a block diagram showing another exemplary embodiment of a 3D image display apparatus according to the invention and FIG. 11 is a view showing an exemplary embodiment of four successive frames, a gate clock signal, and a vertical start signal. In FIG. 10, the same reference numerals denote the same elements in FIG. 6, and thus detailed descriptions of the same elements will be omitted.

Referring to FIG. 10, the 3D image display apparatus 200 includes the timing controller 110, a switching unit 115, the gate driver 130, and the short gate driver 140.

The timing controller 110 outputs a vertical start signal STV and the gate clock signal CPV using the control signal O-CS.

The gate clock signal CPV is applied to the gate driver 130 and the short gate driver 140. The vertical start signal STV is applied to the switching unit 115.

The switching unit 115 applies the vertical start signal STV to one of the gate driver 130 and the short gate driver 140 in response to a switching signal SS.

Referring to FIG. 11, the vertical start signal STV is generated in the high state at the start time point of the left-eye image frame LF and the start time point of the right-eye image frame RF. In addition, the vertical start signal STV is generated in the high state at the start time point of the first black frame BF1 and the start time point of the second black frame BF2.

The switching signal SS is generated in the high state during the first black frame BF1 and the second black frame BF2. Thus, the switching unit 115 applies the vertical start signal STV to the gate driver 130 when the switching signal SS is in a low state and applies the vertical start signal STV to the short gate driver 140 when the switching signal SS is in the high state.

Accordingly, the gate driver 130 may sequentially output the gate signal from the start time point of the left-eye image frame LF or the start time point of the right-eye image frame RF in response to the gate clock signal CPV.

In addition, the short gate driver 140 may sequentially output the short gate signal to the j number of blocks MSGL1 to MSGLj, as shown in FIG. 8, from the start time point of the first black frame BF1 or the start time point of the second black frame BF2 in response to the gate clock signal CPV.

As shown in FIG. 11, since the frequency of the gate clock signal CPV is uniform during the four successive frames, the high period of the short gate signal may have the same width as the high period of the gate signal.

Although not shown in the figures, the gate clock signal CPV in the first and second black frames BF1 and BF2 may have a frequency higher than a frequency in the left- and right-eye image frames LF and RF. That is, the driving frequency of the short gate driver 140 may be greater than the driving frequency of the gate driver 130.

Figure 12:
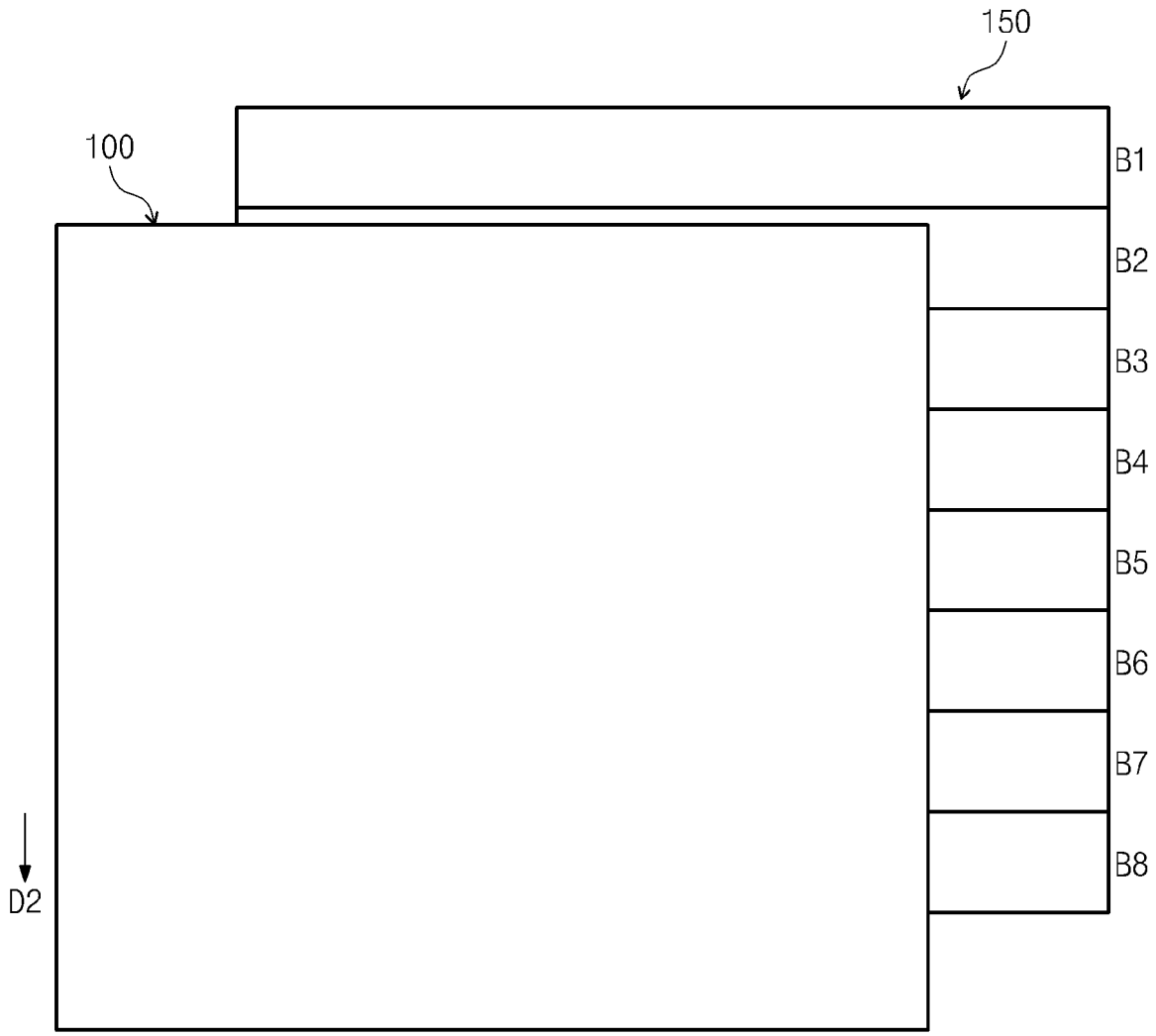
FIG. 12 is a plan view showing a display panel and blocks of a backlight unit for explaining a relationship therebetween.
Figure 13:
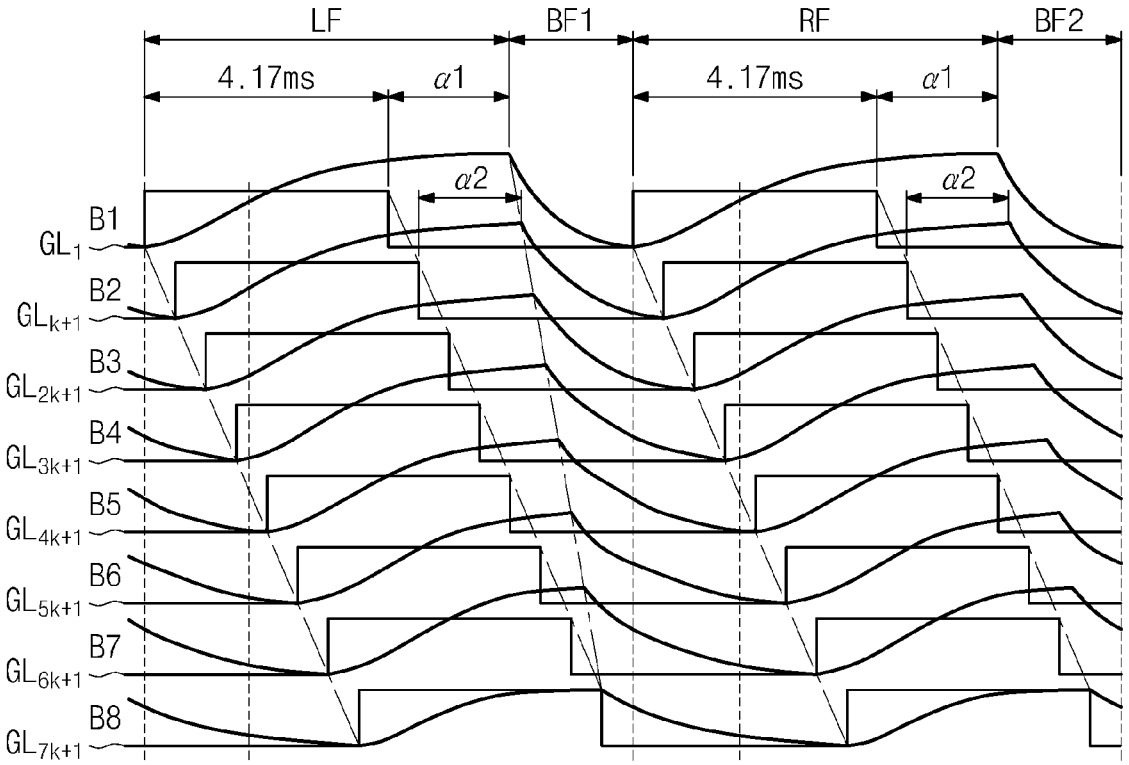
FIG. 13 is a waveform diagram showing a turn-on time of each block of a backlight unit and a variation of a voltage charged in a first pixel row corresponding to each block of the backlight unit.

FIG. 12 is a plan view showing a display panel and blocks of a backlight unit for explaining a relationship therebetween and FIG. 13 is a waveform diagram showing a turn-on time of each block of a backlight unit and a variation of a voltage charged in a first pixel row corresponding to each block of the backlight unit.

Referring to FIG. 12, the backlight unit 150 is disposed at a rear of the display panel 100 and includes the first to eighth blocks B1 to B8. In the backlight unit 150, the first to eighth blocks B1 to B8 are divided in the same direction as the direction D2 in which the gate lines GL1 to GLn are sequentially scanned.

In this case, each of the blocks B1 to B8 corresponds to n/8 gate lines of the gate lines GL1 to GLn of the display panel 100.

In addition, each of the blocks B1 to B8 of the backlight unit 150 may be driven in synchronization with a timing at which the gate signal is applied to a first gate line of the n/8gate lines GL1 to GLn which correspond to a corresponding block.

Referring to FIG. 13, when the gate signal is applied to the first gate line $GL_1$ in the left-eye image frame LF, the first block B1 is turned on during a predetermined period. In a case where the display panel 100 is operated at the frequency of about 240 Hz, the first block B1 is turned on during a time period of about 4.17 ms.

The first pixel row connected to the first gate line receives the data signal in response to the gate signal and is charged until the first black frame BF1 starts.

As shown in FIGS. 8 and 9, in a case where the short gate lines SGL1 to SGLn are driven after being divided into groups each having the i number of the short gate lines, the period of the first and second black frames BF1 and BF2 have 1/i times the width of a period of the left-eye image frame LF or the right-eye image frame RF. Accordingly, in the period of the left-eye image frame LF or the right-eye image frame RF, a charging operation of the first pixel row may be performed during a time period corresponding to the time period of about 4.17 ms plus a first additional time $\alpha 1$.

Since a charging time period of the first pixel row is increased by the first extra time period $\alpha 1$, brightness of the first pixel row may be improved.

When the gate signal is applied to a first gate line, i.e., a (k+1)th gate line $GL_{k+1}$, of the second block B2 in the left-eye image frame LF, the second block B2 is turned on during a predetermined period. In this case, k may be a value of n/8. In a case where the display panel 100 is operated at the frequency of about 240 Hz, the second block B2 is turned on during the time period of about 4.17 ms.

A (k+1)th pixel row connected to the (k+1)th gate line receives the data signal in response to the gate signal and maintains a charging operation during the time period corresponding to the time period of about 4.17 ms plus a second additional time α2. Since a charging time period of the (k+1) th pixel row is increased by the second additional time α2, brightness of the (k+1)th pixel row may be improved.

The third to eighth blocks B3 to B8 are operated in the same or substantially the same way as the first and second blocks B1 and B2. Namely, when the gate signal is applied to a first gate line of one of the third to eighth blocks B3 to B8, i.e., a (2k+1)th gate line $GL_{2k+1}$, a (3k+1)th gate line $GL_{k+1}$, a (4k+1)th gate line $GL_{k+1}$, a (5k+1 )th gate line $GL_{k+1}$, a (6k+1)th gate line $GL_{k+1}$, or a (7k+1)th gate line $GL_{k+1}$, in the left-eye image frame LF, a corresponding block is turned on during a predetermined period. Also, charging time periods of the pixel rows driven in synchronization with the third to eighth blocks B3 to B8 may be increased. Accordingly, brightness of the display panel 100 may be improved.

In an exemplary embodiment, the second additional time α2 may be shorter than the first additional time α1. That is, an additional charging time may be decreased according to an increase in an order of a block to which a corresponding pixel row is synchronized with, i.e., from first to eighth block. A difference between additional charging times may be represented as a gamma difference according to a position of the image displayed on the display panel 100.

In order to reduce the gamma difference according to the position of the image displayed on the display panel 100, the display panel 100 may be divided into three areas, e.g., upper, center, and lower areas, along the second direction D2 and the number of the short gate lines SGL1 to SGLn may vary in each of the upper, center, and lower areas.

That is, in an exemplary embodiment, the additional charging time is the longest in the upper area such that the number of the short gate lines SGL1 to SGLn is largest. In addition, in an exemplary embodiment, the additional charging time is the shortest in the lower area such that the number of the short gate lines SGL1 to SGLn is smallest.

Thus, the gamma difference according to the position of the image may be improved and the brightness of the display panel 100 may be enhanced. As a result, a display quality of the 3D image display apparatus may be improved.

According to the above, each pixel includes a short circuit, and thus, each pixel may display the black image by controlling the operation of the short circuit even though a black data is not applied to each pixel. Thus, the black frame is inserted between the left-eye frame and the right-eye frame, thereby improving a display quality of the 3D image.

In addition, the number of the short gate lines electrically connected to each other is adjusted to control a width of the black frame. Accordingly, a charging time period of each pixel may be increased, and thus, brightness of the display apparatus may be improved.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A display apparatus comprising:

a gate line which receives a gate signal;

a first data line which receives a first data signal;

a second data line which receives a second data signal having a gray scale lower than a gray scale of the first data signal and a polarity opposite to a polarity of the first data signal;

a short gate line which receives a short gate signal; and a plurality of pixels, each pixel comprising:

a first sub-pixel which is connected to the gate line and the first data line and displays a first image corresponding to the first data signal; and a second sub-pixel which is connected to the gate line and the second data line and displays a second image corresponding to the second data signal; and a switching device which electrically connects the first sub-pixel to the second sub-pixel in response to the short gate signal, wherein a pixel displays a display image during an image frame and displays a black image during a black frame, the image frame and the black frame are alternately generated, the first and second sub-pixels are electrically connected to each other through the switching device during the black frame to display a black image corresponding to an average electric potential of the first and second data signals.

2. The display apparatus of claim 1, wherein, among four successive frames, a first frame is a left-eye image frame displaying a left-eye image, a second frame is a first black frame displaying the black image, a third frame is a right-eye image displaying a right-eye image, and a fourth frame is a second black frame displaying the black image.

3. The display apparatus of claim 2, wherein the gate line receives the gate signal during the first and third frames and the short gate line receives the short gate signal during the second and fourth frames.

4. The display apparatus of claim 2, wherein the first sub-pixel comprises:

a first thin film transistor connected to the gate line and the first data line; and a first liquid crystal capacitor connected to a first output electrode of the first thin film transistor, and wherein the second sub-pixel comprises:

a second thin film transistor connected to the gate line and the second data line; and a second liquid crystal capacitor connected to a second output electrode of the second thin film transistor.

5. The display apparatus of claim 4, wherein the switching device comprises:

a control electrode connected to the short gate line;

an input electrode connected to the first output electrode of the first thin film transistor; and a third output electrode connected to the second output electrode of the second thin film transistor.

6. The display apparatus of claim 4, wherein the first liquid crystal capacitor comprises a first sub-pixel electrode connected to the first output electrode of the first thin film transistor, the second liquid crystal capacitor comprises a second sub-pixel electrode connected to the second output electrode of the second thin film transistor, and the second sub-pixel electrode has an area greater than an area of the first sub-pixel electrode.

7. The display apparatus of claim 1, wherein the short gate line is spaced apart from the gate line and extends substantially in parallel to the gate line.

8. A display apparatus comprising:

a display panel including a pixel which displays a display image during an image frame and displays a black image during a black frame, the image frame and the black frame being alternately generated, the pixel including a first sub-pixel, a second sub-pixel, and a short circuit which electrically connects the first and second sub-pixels during the black frame;

a gate driver which applies a gate signal to the first and second sub-pixels during the image frame;

a data driver which applies a first data signal to the first sub-pixel during the image frame and applies a second data signal to the second sub-pixel during the image frame, the second data signal having a gray scale lower than a gray scale of the first data signal and a polarity opposite to a polarity of the first data signal; and a short gate driver which applies a short gate signal to the short circuit during the black frame and electrically connects the first sub-pixel and the second sub-pixel, wherein the first and second sub-pixels are electrically connected to each other through the short circuit during the black frame to display a black image corresponding to an average electric potential of the first and second data signals.

9. The display apparatus of claim 8, wherein the display panel comprises:

a plurality of gate lines which are electrically connected to the gate driver and sequentially receive the gate signal;

a plurality of first data lines which are electrically connected to the data driver and receive the first data signal;

a plurality of second data lines which are electrically connected to the data driver and receive the second data signal; and a plurality of short gate lines which are electrically connected to the short gate driver and sequentially receive the short gate signal.

10. The display apparatus of claim 9, wherein the short gate lines are divided into j number of groups, each group comprises i number of short gate lines, and the i number of the short gate lines of each group are electrically connected to each other.

11. The display apparatus of claim 10, wherein the short gate driver sequentially applies the short gate signal to the j number of groups and substantially simultaneously drives the i number of the short gate lines of each group.

12. The display apparatus of claim 10, wherein the black frame has a time width at least 1/i times smaller than a time width of the image frame.

13. The display apparatus of claim 9, wherein the first sub-pixel comprises:

a first thin film transistor connected to a corresponding gate line of the gate lines and a corresponding first data line of the first data lines; and a first liquid crystal capacitor connected to a first output electrode of the first thin film transistor, and wherein the second sub-pixel comprises:

a second thin film transistor connected to the corresponding gate line of the gate lines and a corresponding second data line of the second data lines; and a second liquid crystal capacitor connected to a second output electrode of the second thin film transistor.

14. The display apparatus of claim 13, wherein the short circuit comprises a short switching device including a control electrode connected to a corresponding short gate line of the short gate lines, an input electrode connected to the first output electrode of the first thin film transistor, and a third output electrode connected to the second output electrode of the second thin film transistor.

15. The display apparatus of claim 8, wherein the short gate driver has a driving frequency equal to or greater than a driving frequency of the gate driver.

16. The display apparatus of claim 8, further comprising a timing controller which controls a drive of the gate driver, the data driver, and the short gate driver.

17. The display apparatus of claim 16, wherein the timing controller generates a first vertical start signal which starts the drive of the gate driver and a gate clock signal which determines a timing at which the gate signal is applied to the gate lines, applies the first vertical start signal and the gate clock signal to the gate driver, generates a second vertical start signal which starts the drive of the short gate driver and a short gate clock signal which determines a timing at which the short gate signal is applied to the short gate lines, and applies the second vertical start signal and the short gate clock signal to the short gate driver.

18. The display apparatus of claim 17, wherein a frequency of the gate clock signal during the black frame is equal to or greater than a frequency during the image frame.

19. The display apparatus of claim 8, further comprising:

a timing controller configured to control a drive of the gate driver, the data driver, and the short gate driver and generate a vertical start signal which starts the drive of the gate driver and the short gate driver and a gate clock signal which determines a timing at which the gate signal and the short gate signal are applied; and a switching unit configured to switch the vertical start signal, in response to a switching signal, to be applied to the gate driver or the short gate driver.

20. The display apparatus of claim 19, wherein the switching unit applies the vertical start signal to the gate driver in the image frame in response to the switching signal and applies the vertical start signal to the short gate driver in the black frame in response to the switching signal.

21. A method of driving a display apparatus, the method comprising:

applying a first data signal to a first sub-pixel during an image frame;

applying a second data signal to a second sub-pixel during the image frame, the second data signal having a gray scale lower than a gray scale of the first data signal and a polarity opposite to a polarity of the first data signal;

applying a gate signal to the first and second sub-pixels during the image frame; and applying a short gate signal to a short circuit and electrically connecting the first sub-pixel and the second sub-pixel during a black frame, wherein the image frame and the black frame are alternately generated, the display apparatus comprising:

a display panel including a pixel which displays a display image during the image frame and displays a black image during the black frame, the pixel including the first sub-pixel, the second sub-pixel, and the short circuit;

a gate driver which applies the gate signal;

a data driver which applies the first data signal and the second data signal; and a short gate driver which applies the short gate signal, wherein the first and second sub-pixels are electrically connected to each other through the short circuit during the black frame to display a black image corresponding to an average electric potential of the first and second data signals.

* * * * *